US007055816B2

(12) United States Patent
Leu

(10) Patent No.: US 7,055,816 B2
(45) Date of Patent: Jun. 6, 2006

(54) METHOD OF PROCESSING SHEET-LIKE PRODUCTS, AND APPARATUS FOR IMPLEMENTING THE METHOD

(75) Inventor: Willi Leu, Pfaffikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/817,269

(22) Filed: Apr. 2, 2004

(65) Prior Publication Data

US 2004/0188931 A1 Sep. 30, 2004

Related U.S. Application Data

(63) Continuation of application No. PCT/CH02/00446, filed on Aug. 14, 2002.

(30) Foreign Application Priority Data

Oct. 5, 2001 (CH) ..... 1834/01

(51) Int. Cl.
*B65H 5/22* (2006.01)

(52) U.S. Cl. ..... 271/3.01; 271/3.05; 271/3.06; 271/216; 271/184; 414/790.2; 414/789

(58) Field of Classification Search ..... 271/237, 271/243, 244, 245, 246, 3.01, 3.02, 3.04, 271/3.05, 3.06, 3.08, 3.09, 216, 212, 182, 271/184, 902, 225; 414/789, 790.2, 900; 270/58.33

See application file for complete search history.

(56) References Cited

U.S. PATENT DOCUMENTS 2,805,757 A * 9/1957 Rapley ..... 198/434
3,596,575 A * 8/1971 Brockmuller ..... 414/789
3,622,149 A * 11/1971 Enskat ..... 271/35
3,724,840 A * 4/1973 Kuckhermann ..... 271/182
3,830,144 A * 8/1974 Kuckhermann et al. .... 414/789
3,834,288 A * 9/1974 Behrens et al. ..... 198/418.9
3,880,059 A * 4/1975 Brockmuller ..... 414/789
3,964,598 A * 6/1976 Alsop ..... 198/415
4,046,369 A * 9/1977 Kluge et al. ..... 271/3.05
4,125,253 A * 11/1978 Wangermann ..... 270/52.06
4,127,262 A 11/1978 Eberle et al.
4,214,743 A * 7/1980 Meier ..... 271/182
4,296,684 A * 10/1981 Wangermann ..... 100/292
4,320,894 A * 3/1982 Reist et al. ..... 271/277
4,443,287 A * 4/1984 Worni ..... 156/247
4,465,270 A * 8/1984 Amato ..... 271/198
4,534,550 A * 8/1985 Reist ..... 271/183
4,546,871 A * 10/1985 Duke ..... 198/418.9
4,604,851 A * 8/1986 Reist ..... 53/430
4,667,950 A * 5/1987 Linder et al. ..... 271/245

(Continued)

FOREIGN PATENT DOCUMENTS

CH 436 349 5/1967

(Continued)

*Primary Examiner*—Donald P. Walsh
*Assistant Examiner*—Matthew J. Kohner
(74) *Attorney, Agent, or Firm*—Alston & Bird LLP

(57) ABSTRACT

A method and apparatus for processing a stream of sheet-like products, such as printed magazines and newspapers, whereby the orientation of the products in the stream is changed to facilitate subsequent processing. The products are conveyed in an imbricated stream, or in a non-imbricated stream, and sections of adjacent products are combined into stacks which are conveyed away from the trailing products once the stacks are formed. The stacks are then further processed so that the products in each stack are disposed in a reverse order in relation to their original order, i.e. last in/first out.

26 Claims, 5 Drawing Sheets

U.S. PATENT DOCUMENTS

| | | | | | |
|---|---|---|---|---|---|
| 4,771,896 | A | | 9/1988 | Newsome | |
| 4,905,981 | A | * | 3/1990 | Reist | 271/233 |
| 5,129,643 | A | * | 7/1992 | Johnson et al. | 271/216 |
| 5,228,373 | A | * | 7/1993 | Welsch | 83/24 |
| 5,326,088 | A | | 7/1994 | Newsome | |
| 5,456,573 | A | * | 10/1995 | Morris et al. | 414/789.9 |
| 5,575,463 | A | * | 11/1996 | Parkander | 270/52.02 |
| 5,613,673 | A | * | 3/1997 | Roberts et al. | 271/182 |
| 5,704,604 | A | | 1/1998 | Koelle et al. | |
| 5,711,521 | A | * | 1/1998 | Reist | 271/225 |
| 5,725,209 | A | * | 3/1998 | Takahashi et al. | 271/122 |
| 5,733,099 | A | * | 3/1998 | Honneger | 414/788 |
| 5,913,656 | A | * | 6/1999 | Collins | 414/801 |
| 6,193,229 | B1 | * | 2/2001 | Hall et al. | 271/109 |
| 6,267,372 | B1 | * | 7/2001 | Mylaeus et al. | 271/250 |
| 6,295,922 | B1 | * | 10/2001 | Salamone et al. | 100/7 |
| 6,446,962 | B1 | * | 9/2002 | Taffertshofer | 271/312 |
| 6,619,651 | B1 | * | 9/2003 | Mader | 271/82 |
| 6,672,582 | B1 | * | 1/2004 | Dittli et al. | 271/182 |
| 2003/0017043 | A1 | * | 1/2003 | Reist | 414/789 |

FOREIGN PATENT DOCUMENTS

| | | | | |
|---|---|---|---|---|
| CH | 598 106 | | | 11/1978 |
| CH | 682 484 | A5 | | 9/1993 |
| DE | 3336820 | A1 | * | 5/1984 |
| EP | 107645 | A2 | * | 5/1984 |
| EP | 0 526 677 | A1 | | 2/1993 |
| EP | 0 806 391 | A1 | | 11/1997 |
| JP | 62021675 | A | * | 1/1987 |
| JP | 62088772 | A | * | 4/1987 |
| WO | WO 93 15006 | A | | 8/1993 |

* cited by examiner

METHOD OF PROCESSING SHEET-LIKE PRODUCTS, AND APPARATUS FOR IMPLEMENTING THE METHOD

CROSS REFERENCE TO RELATED APPLICATION

The present application is a continuation of international application PCT/CH02/00446, filed 14 Aug. 2002, and which designates the U.S. The disclosure of the referenced application is incorporated herein by reference.

BACKGROUND OF THE INVENTION

The invention relates to a method of processing sheet-like products, in particular generally flat flexible printed products, and to an apparatus for implementing the method.

Sheet-like products, for example printed products, are often transported in the horizontally lying state. In the case of a folded printed product, it is possible for the folded edge to be oriented, for example, toward the front or rear and for the front page to be oriented in each case upward or downward, i.e. there are at least four orientations. In the case of products transported in an imbricated formation, a product is located either on the preceding product, as seen in the conveying direction (normal imbricated formation), or on the following product (inverse imbricated formation), this resulting in a total of at least eight possible formations. However, stations in which the products are further processed, for example insertion means, are often adapted to the printed products being fed in a predetermined orientation, e.g. with the folded edge leading and the front page oriented upward. This orientation very often does not correspond to the orientation in which the products leave the previous process. It is thus necessary for the formation of the products to be changed prior to further processing.

For this purpose, it is known for products which arrive in an imbricated formation to be separated by being accelerated in relation to the rest of the products of the imbricated formation and being rearranged. It is also known for the products to be deformed, in order to change the mutual orientation of the products in relation to the initial formation. In the case of both methods, the products are subjected to comparatively high forces.

The object of the invention is to provide a method of processing sheet-like products, in particular printed products, in which products which are conveyed in an imbricated formation or individually are fed to a further processing station in a predetermined orientation, the intention being for the products to be reoriented gently and with low mechanical outlay.

SUMMARY OF THE INVENTION

The above and other objects and advantages are achieved by the provision of a method and apparatus which comprises at least the following steps: a) conveying the products in a continuous or interrupted imbricated formation, or in a non-imbricated formation; b) combining a plurality of products conveyed one behind the other (referred to herein as a section of adjacent products) to form an intermediate stack; c) conveying the intermediate stacks further once they have been formed, and/or while they are being formed, such that a gap is produced in relation to subsequent products, as seen in the conveying direction; and d) further processing the products in each intermediate stack in the reverse order in relation to the original order (i.e., last in/first out).

The apparatus for implementing the method comprises at least a first conveying arrangement for conveying products in an imbricated or non-imbricated formation, and a stack forming arrangement for forming intermediate stacks from a section of adjacent products conveyed one behind the other. Further a feed arrangement is provided by means of which the intermediate stack for the products in a section can be transferred to a further processing station such that the products in each stack are processed further in the reverse order in relation to the original order. The feed arrangement preferably comprises a stack reducing means for this purpose.

The method according to the invention has the advantage that the products are handled very gently since they are combined to form an intermediate stack at low relative speeds, in particular by stationary or moving stops or stoppers which can be introduced into the conveying path. A section comprises at least two, preferably 3 to 10 products which are conveyed one behind the other and arrive in an imbricated formation or individually.

By virtue of the products in an intermediate stack being processed further in the reverse order in relation to their initial positioning, a change in formation, for example a change from a normal imbricated formation to an inverse imbricated formation and vice-versa, can take place in a surprisingly straightforward manner. Separation in the sense of the products being completely isolated from one another is avoided. The high accelerations used for separating purposes in the prior art and the corresponding high outlay gripping and conveying equipment are thus also avoided.

The intermediate stack can be formed extremely straightforwardly in design terms by a belt conveyor interacting with a stop or a stopper. In order to form an intermediate stack, it is also possible to use further stack forming arrangements which are known from the prior art. If products arrive in a normal imbricated formation, the intermediate stack is preferably built and reduced from above; for the initially inverse imbricated formation, the intermediate stack is built up and reduced from beneath.

Stack reduction preferably takes place by the intermediate stack being conveyed against a screen, as a result of which the products are offset in relation to one another and/or the stack is spread out. Further processing may take place in a cyclic or non-cyclic manner. If it takes place cyclically, the stack reducing means preferably has a feeder function.

A further processing station in the context of the invention is any arrangement in which the products are processed directly, e.g. an insertion means, or are conveyed further for the purpose of further processing, e.g. an intermediate conveyor. The incoming products or intermediate stacks are conveyed by a first and a second conveying arrangement, preferably a belt conveyor. If the intermediate stacks are to be conveyed at the same speed as the imbricated formation, it is also possible to use a common conveying arrangement.

The feed arrangement preferably likewise comprises a conveying arrangement, for example a belt conveyor, and means which transfer the intermediate stack or the products thereof to the further processing station such that, in accordance with the "last in/first out" principle, the final product in a section is the first to be processed further. The means include, for example, stack reducing means which are known per se, e.g. according to CH 598 106 and U.S. Pat. No. 4,127,262 (stack reduction from beneath) or CH 436 349 (stack reduction from above). In order to convert an intermediate stack into an imbricated formation again, it is also possible for the above mentioned means to be screens or pushing elements by means of which the intermediate stacks can be drawn apart again.

The intermediate stacks are removed, e. g. ejected or drawn away, from the stack forming arrangement at a speed which is selected in dependence on the number of products in a section, on the initial conveying speed and on the length of the intermediate stack measured in the conveying direction, such that a gap is formed in relation to the subsequent products. It is also possible for the intermediate stack, once it has left the stack forming arrangement, to be set down directly on a further conveyor with a conveying speed which is selected, for example, such that the intermediate stack overlaps the previously set down intermediate stack in part and an imbricated formation comprising intermediate stacks is formed. Such an imbricated formation can be converted particularly straightforwardly, by a spreading out action, into an imbricated formation comprising individual products. As an alternative, it is possible for the intermediate stacks to be set down on the conveyor at a spacing apart from one another and to be converted into a local imbricated formation again, for example, likewise by a pushing element. Additional possible reorienting methods are achieved by an additional turning step, in which the incoming imbricated formation is preferably turned as a whole. Suitable turning means are known from the prior art, e.g. note U.S. Pat. No. 3,659,699.

BRIEF DESCRIPTION OF THE DRAWINGS

Examples for implementing the invention are illustrated in the drawings, in which, purely schematically.

DETAILED DESCRIPTION OF THE PREFERRED EMBODIMENTS

Figure 1A:
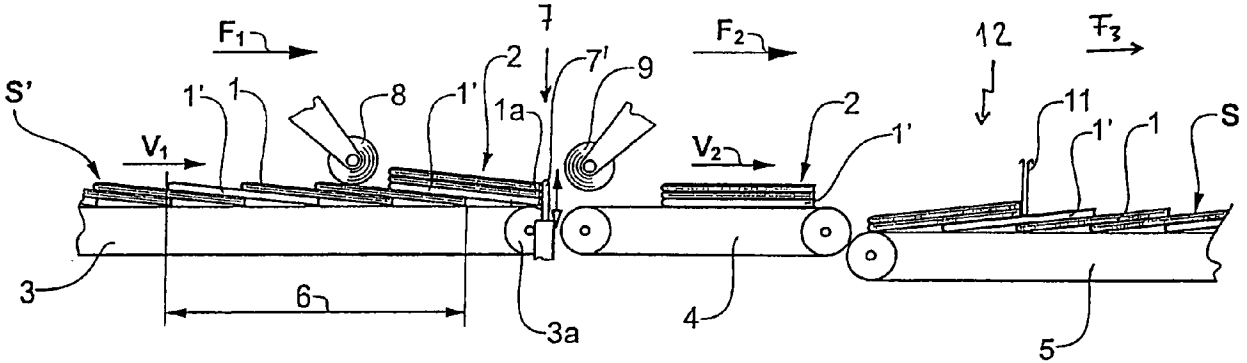
FIGS. 1*a–c* show a longitudinal section through an apparatus according to the invention in three different method stages.
Figure 1B:
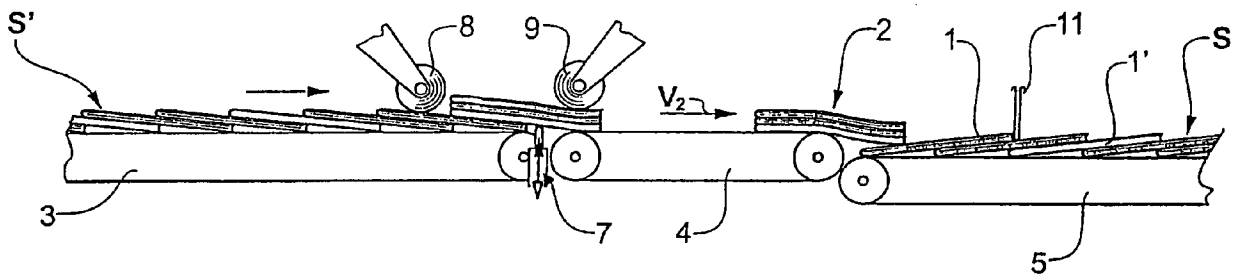
Figure 1C:
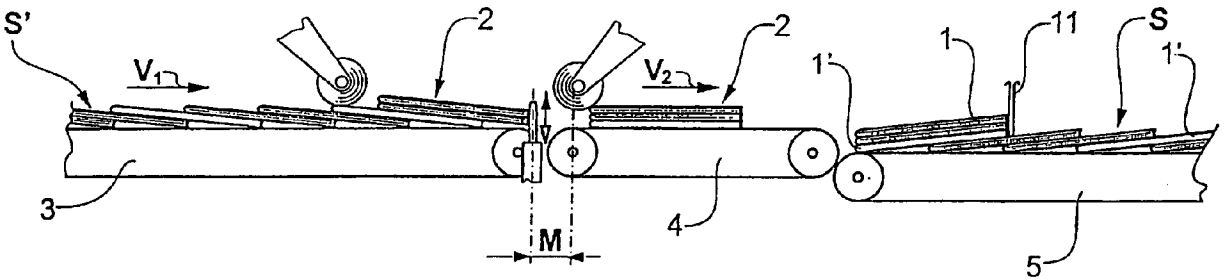
Figure 2:
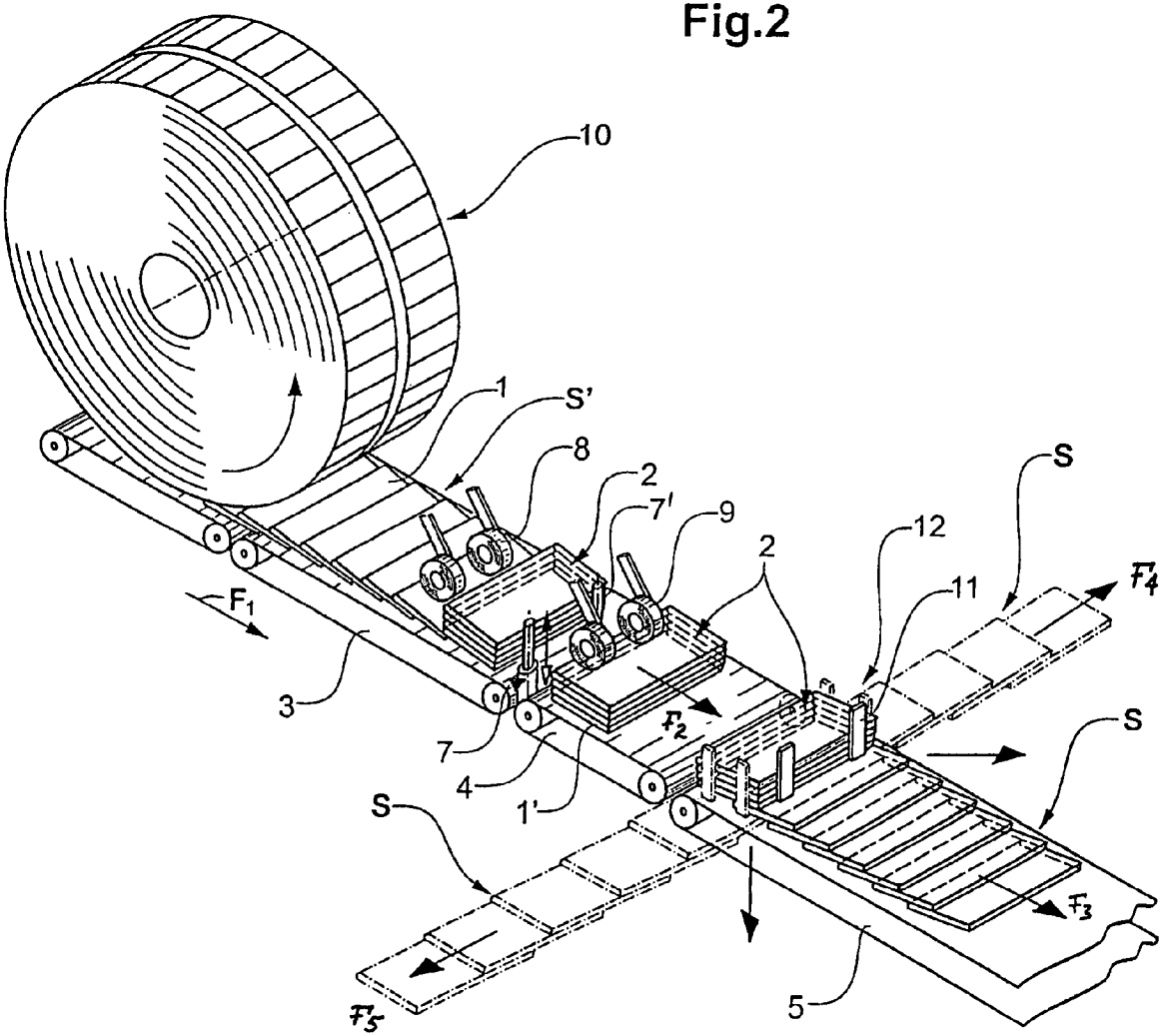
FIG. 2 shows three dimensional view of an apparatus according to the invention.

In FIGS. 1*a*–1*c*, different method stages are illustrated schematically with reference to an apparatus for implementing the method, this apparatus being shown in longitudinal section. FIG. 2 shows a three dimensional view of this apparatus. Products 1, in this case folded printed products, are unwound from a roll 10 (FIG. 2), with an inverse imbricated formation S' being formed in the process, and are conveyed by a first conveying arrangement 3, in the form of a belt conveyor, at the conveying speed $V_1$. Located at the front end 3*a* of the first conveying arrangement 3, as seen in the conveying direction F1, is a stack forming arrangement 7 with a stop 7', which can be moved into the conveying path (FIGS. 1*a, c*) and removed therefrom again (FIG. 1*b*). The movement of the stop 7' is controlled by a control arrangement (not shown here) such that a predetermined number of products are braked or the conveying path is blocked for a predetermined period of time.

In the position which is shown in FIGS. 1*a* and 1*c*, the stop 7' blocks the products 1 from being transported further, with the result that these products are pushed up to form an intermediate stack 2 by the conveying arrangement 3. The leading edges 1*a* are aligned on the stop 7'. The inverse imbricated formation S' automatically results in the products 1 being fed to the stack 2 from beneath in each case and in the final product 1' in a section 6 being located at the bottom. In order to assist the feed movement, use is made of a roller 8, for example an adhesion roller.

Once the intermediate stack 2 has been formed, the stop 7' is moved downward, and the intermediate stack 2 is conveyed further by the first conveying arrangement 3 and transferred to a second conveying arrangement 4, in this case likewise in the form of a belt conveyor. A height adjustable roller arrangement 9 serves for forcing the intermediate stack 2 vertically onto the second conveying arrangement 4, in order thus to ensure that the intermediate stack 2 is reliably conveyed further in the transfer region and to draw off the intermediate stack, if appropriate, from the first conveying arrangement 3. The spacing M between the conveying arrangements 3, 4 is adapted to the product length and the conveying speeds. As soon as the leading edges la of the products 1 in the intermediate stack 2 rest on the second conveying arrangement 4, the stop 7' is moved upward again in order to stop the first product in a new section 6.

The second belt conveyor 4 is adjoined by a further conveying arrangement 5 which has its conveying plane located beneath the conveying plane of the first and second conveying arrangements 3, 4, with the result that the intermediate stacks can be set down from above. As stack reducing arrangement 12, use is made of an obstruction 11, which leaves a gap free in relation to the conveying plane, in conjunction with the further conveying arrangement 5, as a result of which the products are spread out to form a normal formation S as they are conveyed further.

In the example shown, the conveying directions F2 and F3 of the second and further conveying arrangements 4, 5, respectively, are colinear with the conveying direction F1. However, it is basically possible for the intermediate stack 2 to be conveyed further in any of several conveying directions, such as the directions F2, F3, F4, F5 indicated in FIG. 2. The conveying speed $V_2$ can be selected in dependence on the target. In the present case, it is at least of such a magnitude that the intermediate stacks 2 are spaced apart from one another on the second conveying arrangement 4.

Figure 5:
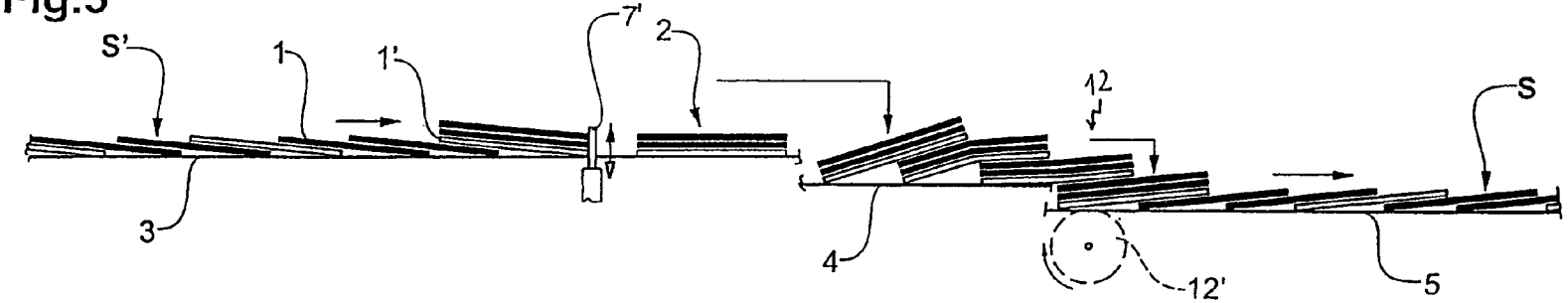

As is illustrated in FIG. 5, it is also possible, however, for the trailing intermediate stack to be set down, in part, on the preceding intermediate stack directly at the outlet of the stack forming arrangement 7. This requires a correspondingly low conveying speed $V_2$. In this case, the bearing surface of the second conveying arrangement is already at a lower level than the bearing surface of the first conveying arrangement, or there are means present for raising the intermediate stacks formed and for setting them down in a partially overlapping manner on the preceding intermediate stack.

Figure 3:
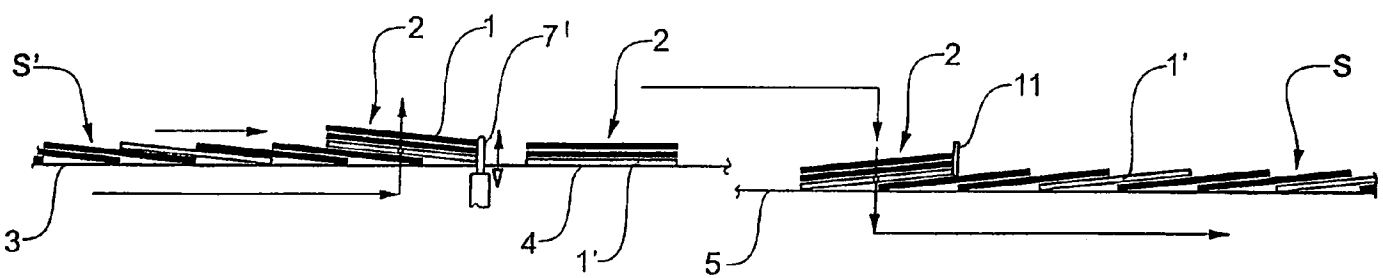
FIGS. 3–6 show examples of a normal imbricated formation being produced from an inverse imbricated formation, with stack formation on a stationary stop.

The operation which is shown in FIGS. 1*a–c* and 2 is also illustrated schematically in FIG. 3, the first and second conveying arrangements 3, 4 being realized by a common conveying belt.

Figure 4:
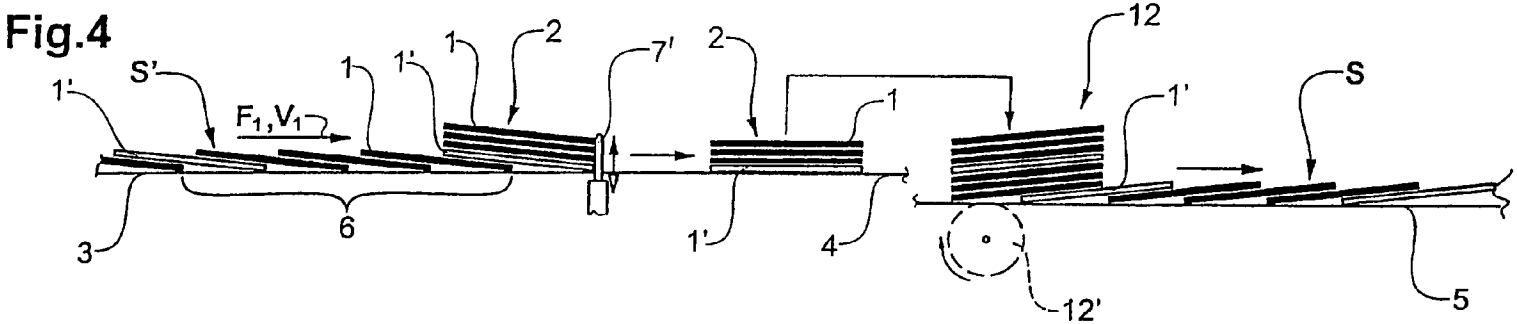

FIG. 4 shows a normal imbricated formation S being formed from an inverse imbricated formation S'. The intermediate stack 2, once formed, is set down on top of a further intermediate stack. For this purpose, it is raised up, if appropriate, by suitable means. This assembled stack is reduced continuously from beneath by a reducing means 12, which comprises, for example, an adhesion roller as separating element 12'. The products are transported away in a normal imbricated formation S by the further conveying arrangement 5. The conveying arrangements 3, 4, 5 may be realized by individual belt conveyors or a common belt conveyor.

FIG. 5 shows a normal imbricated formation S being formed from an inverse imbricated formation S'. The intermediate stacks 2 are set down on the preceding intermediate stack, in part in each case, by a suitable gripping and raising means or by being set down on a lower level conveying arrangement 4, 5. The intermediate formation comprising overlapping intermediate stacks is evened out into a normal imbricated formation S, as shown in FIG. 4, by a stack reducing means 12. It is also possible to use a reducing means 12 as in FIG. 3.

Figure 6:
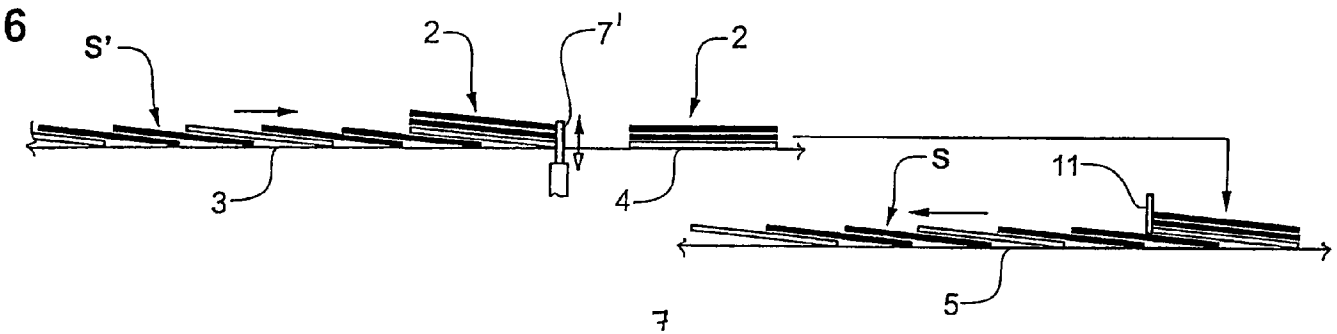

In the variant of the method according to FIG. 3 which is shown in FIG. 6, a change in direction takes place during stack reduction.

Figure 7:
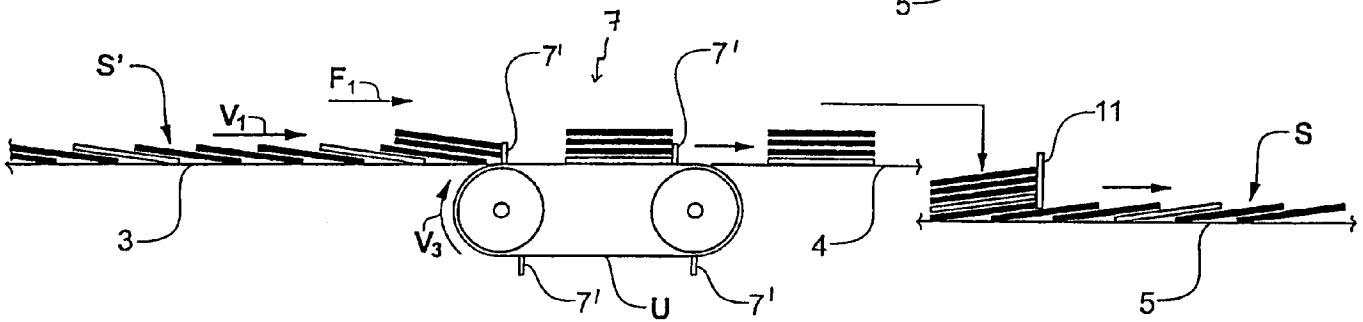
FIG. 7 shows the stack formation on a movable stop.

Instead of a stationary stop, it is also possible for the intermediate stacks 2, as is illustrated in FIG. 7, to be formed on movable stops 7'. The stops 7' are moved in the conveying direction F1 along a continuous circulatory path U, at a speed $V_3$ which is lower than the first conveying speed $V_1$. It is thus the case that the products run against the stop only at the difference in speed $V_1$–$V_3$, and are thus pushed together very gently. The stack size and the stack spacing may be set by suitable selection of the difference in speed, of the length of section and of the spacing of the stops 7'. A control means may be dispensed with. It is similarly possible for the products of a normal imbricated formation to be pushed together to form stacks by stops moving at a quicker speed than $V_1$, by action on the trailing edges.

Figure 8:
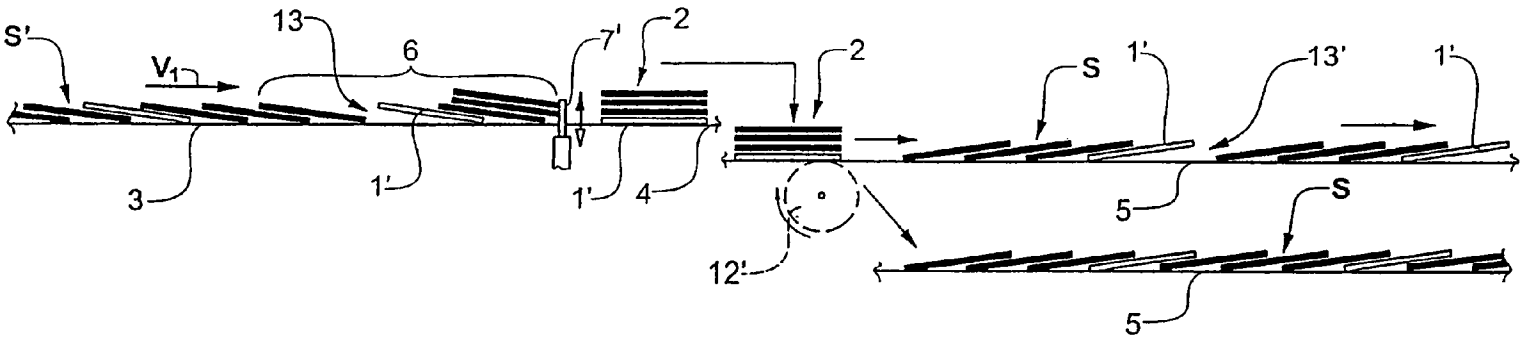
FIG. 8 shows an example of the compensation for gaps in the initial formation.

FIG. 8 shows a possible way of compensating for a gap 13 in the incoming formation by a suitable selection of the stack reducing speed and/or of the conveying speed. The storage function of the intermediate stacks is an additional advantage over separation based arrangements for formation changing purposes.

Figure 9:
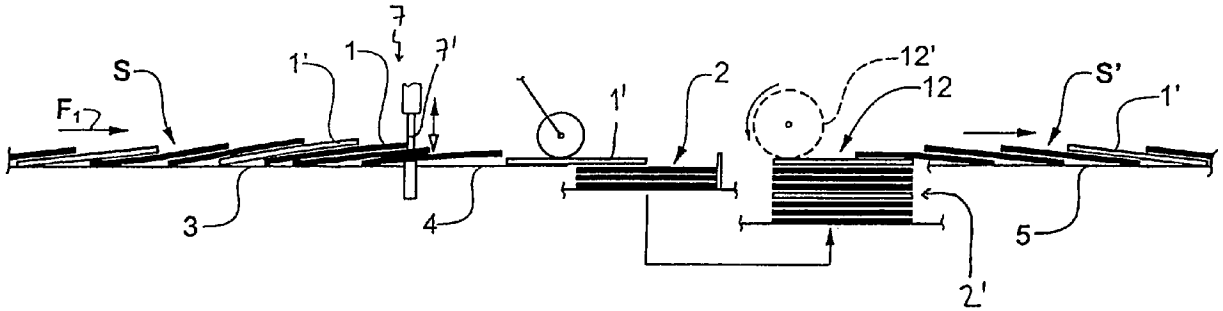
FIG. 9 shows the formation of an inverse imbricated formation from a normal imbricated formation.

FIG. 9 shows an inverse imbricated formation S' being formed from a normal imbricated formation S, the intermediate stack 2 being positioned on a further intermediate stack from beneath. Since the incoming products 1 are conveyed in a normal imbricated formation S, the stop 7' engages in the conveying route from above. In the present case, two products are clamped in by the stop 7', while the final product of the preceding section is conveyed further and fed to the virtually complete intermediate stack 2 from above. The intermediate stack 2 is positioned on preceding intermediate stacks from beneath. The assembled stack 2' is reduced continuously from above by a stack reducing means 12 with a separating element 12', which pushes the respectively uppermost product out of the stack. Arranged downstream of the stack reducing means, as in FIG. 5, is a further conveying arrangement 5, which serves for transporting away the outgoing imbricated formation S'.

Figure 10:
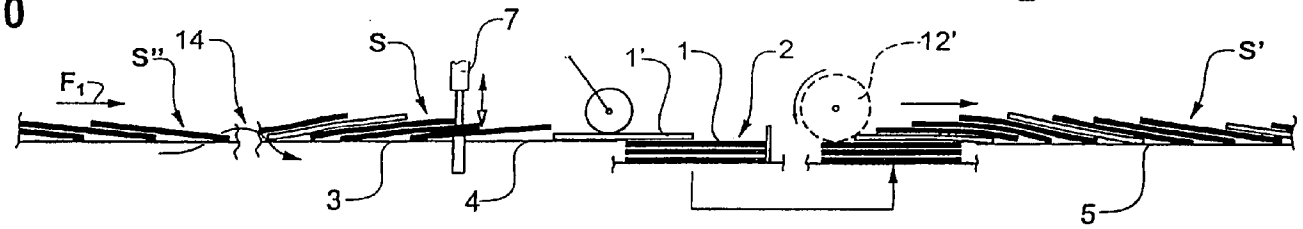
FIGS. 10, 11 show the method according to FIG. 9 with a turning step prior to stack formation.

FIG. 10 shows an inverse imbricated formation S' being formed from a normal imbricated formation S. This has come about by an inverse imbricated formation S" being rotated as a whole through 180°, by means of a turning arrangement 14, about an axis running in the conveying direction $F_1$. The stack formation and stack reduction corresponds to FIG. 9. This achieves a reversal in the position of the front page in the imbricated stream S in relation to the imbricated stream S".

Figure 11:
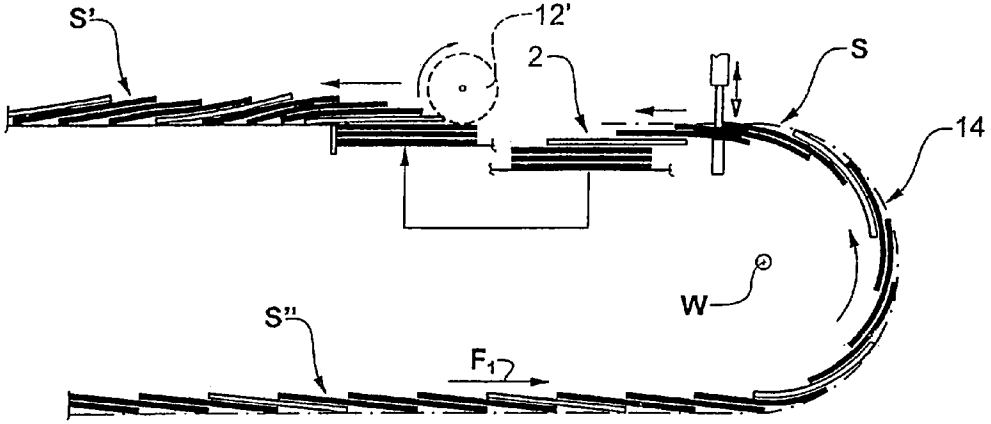

FIG. 11 shows an apparatus according to the invention having a turning means 14 which is arranged upstream of the stack forming arrangement. The entire, initially inverse imbricated formation S" is turned through 180 degrees about a horizontal axis W running transversely to the conveying direction $F_1$. A normal imbricated formation S is thus present prior to stack formation. The intermediate stack 2, which is formed from above, is also reduced from above, this resulting in the outgoing imbricated formation being an inverse imbricated formation S' in which the top side and underside of the products have been changed over in relation to the products in the incoming state.

While the embodiments of the invention which are specifically illustrated and described herein involve imbricated formations leading to and from the stack forming arrangement, it will be understood that the invention encompasses non-imbricated streams as well. For example, a section of a non-imbricated stream could be delivered to a stack forming apparatus which builds the stack from below and the resulting stack could then be reduced by removing products from beneath to form a non-imbricated and oppositely ordered stream. Similarly, a section of a non-imbricated stream could be delivered so as to build the intermediate stack from above, with the stack then being reduced from above.

What is claimed is:

1. A method of changing the formation of an imbricated stream of generally flat flexible products comprising the steps of conveying the products in a predetermined original order in an inverse imbricated formation wherein each product rests at least in part on the trailing product at an initial conveying speed in a conveying direction, combining a plurality of the conveyed products which define a section of adjacent products, to form an intermediate stack, conveying the intermediate stack once it has been formed, and/or while it is being formed, such that a gap is formed in relation to subsequent products as seen in the conveying direction, displacing each product in the intermediate stack so as to form a normal imbricated formation wherein each product rests at least in part on the leading product and wherein the order of the products is reversed from said predetermined original order; and wherein the step of displacing each product includes moving the first product displaced from the intermediate stack such that it rests at least partially on the last product of a previous intermediate stack.

2. The method of claim 1 comprising the further step of determining the number of products in the stack, the initial conveying speed, and the length of the intermediate stack measured in the conveying direction, and wherein the intermediate stack, once formed, is conveyed further at a conveying speed which is selected in dependence on the determined number of products in the stack, on the determined initial conveying speed, and on the determined length of the intermediate stack measured in the conveying direction such that a gap is formed in relation to subsequent products.

3. The method of claim 1 wherein the combining step includes braking the first product in the section of products relative to the trailing products in the section so that the trailing products in the section end up located beneath the first product to form an intermediate stack and wherein the step of displacing each product includes removing products from the intermediate stack from beneath.

4. The method of claim 1 wherein the step of combining the products includes conveying all of the products in the section against a stop to brake the products and so that the leading edges of the products are aligned.

5. The method of claim 4 wherein the step of conveying the products further includes positioning the products on a first conveying arrangement which defines a path of travel, and wherein the stop is selectively introduced into the path of travel, and so that upon removal of the stop the intermediate stack is conveyed further by the first conveying arrangement to a second conveying arrangement.

6. The method of claim 5 wherein the stop is controlled such that it is introduced into the path of travel for a predetermined time or until it brakes a predetermined number of products, and then removed.

7. The method of claim 1 wherein the step of displacing each product in the intermediate stack includes conveying the intermediate stack upon a bearing surface and against an obstruction which forms a gap with the bearing surface through which only a predetermined number of products can pass.

8. The method of claim 1 wherein the intermediate stack, once formed, is conveyed further so that the stack overlaps a previously formed intermediate stack.

9. The method of claim 1 wherein the step of conveying the products includes, prior to the combining step, turning the stream as a whole, so that the initially upwardly oriented sides of the products are oriented downward, and vice-versa.

10. The method of claim 1 wherein the section of adjacent products which is formed into the intermediate stack comprises between two and ten products.

11. The method of claim 1 comprising the further step of combining a plurality of the conveyed products which define a section of adjacent products, to form an intermediate stack such that the sides of the products which are directed toward one another in the imbricated formation are also directed toward one another in the intermediate stack.

12. An apparatus for changing the formation of an imbricated stream of generally flat flexible products comprising a conveyor for conveying the products in a predetermined original order in an imbricated stream at an initial conveying speed along a path of travel, a stack forming arrangement positioned along the path of travel for combining a plurality of the conveyed products which define a section of adjacent products, to form an intermediate stack, a feed arrangement by means of which the intermediate stack is conveyed away from the stack forming arrangement such that a gap is formed in relation to subsequent products as seen in the conveying direction;

a stack reducing arrangement having provision for displacing the products in the intermediate stack in a reverse order with respect to the original order; and a further conveyor for conveying away the products in an imbricated stream.

13. The apparatus of claim 12 wherein the stack forming arrangement comprises a stop which is mounted for selective movement into and out of the path of travel and so as to brake the initial product of the section of products when moved into the path of travel, and with the stop being either at a fixed location along the path of travel or mounted for movement away from the conveyor at a speed lower than said initial conveying speed.

14. The apparatus of claim 12 wherein the stack forming arrangement comprises at least one pushing element which is moved at a higher speed than the initial conveying speed and by means of which the products in the section are pushed together from behind to form the intermediate stack.

15. The apparatus of claim 12 wherein the feed arrangement comprises a conveying arrangement which is capable of receiving the intermediate stack from said conveyor and conveying it further.

16. The apparatus of claim 12 wherein the stack reducing arrangement comprises pushing means mounted for movement relative to the intermediate stack such that each product in the intermediate stack is displaced relative to the adjacent products located in the intermediate stack.

17. A method of changing the formation of an imbricated stream of generally flat flexible products comprising the steps of conveying the products in a predetermined original order in a normal imbricated formation wherein each product rests at least in part on the leading product at an initial conveying speed in a conveying direction;

combining a plurality of the conveyed products which define a section of adjacent products, to form an intermediate stack;

conveying the intermediate stack once it has been formed, and/or while it is being formed, such that a gap is formed in relation to subsequent products as seen in the conveying direction;

displacing each product in the intermediate stack so as to form an inverse imbricated formation wherein each product rests at least in part on the trailing product and wherein the order of the products is reversed from said predetermined original order; and wherein the step of displacing each product includes moving the first product displaced from the intermediate stack such that it is located at least partially beneath the last product of a previous intermediate stack.

18. The method of claim 17 comprising the further step of determining the number of products in the stack, the initial conveying speed, and the length of the intermediate stack measured in the conveying direction, and wherein the intermediate stack, once formed, is conveyed further at a conveying speed which is selected in dependence on the determined number of products in the stack, on the determined initial conveying speed, and on the determined length of the intermediate stack measured in the conveying direction such that a gap is formed in relation to subsequent products.

19. The method of claim 17 wherein the combining step includes braking the first product in the section of products relative to the trailing products in the section so that the trailing products in the section end up located on the first product to form an intermediate stack and wherein the step of displacing each product includes removing products from the intermediate stack from above.

20. The method of claim 17 wherein the step of combining the products includes conveying all of the products in the section against a stop to brake the products and so that the leading edges of the products are aligned.

21. The method of claim 20 wherein the step of conveying the products further includes positioning the products on a first conveying arrangement which defines a path of travel, and wherein the stop is selectively introduced into the path of travel, and so that upon removal of the stop the intermediate stack is conveyed further by the first conveying arrangement to a second conveying arrangement.

22. The method of claim 21 wherein the stop is controlled such that it is introduced into the path of travel for a predetermined time or until it brakes a predetermined number of products, and then removed.

23. The method of claim 17 wherein the intermediate stack, once formed, is conveyed further so that the stack overlaps a previously formed intermediate stack.

24. The method of claim 17 wherein the step of conveying the products includes, prior to the combining step, turning the stream as a whole, so that the initially upwardly oriented sides of the products are oriented downward, and vice-versa.

25. The method of claim 17 wherein the section of adjacent products which is formed into the intermediate stack comprises between two and ten products.

26. The method of claim 17 comprising the further step of combining a plurality of the conveyed products which define a section of adjacent products, to form an intermediate stack such that the sides of the products which are directed toward one another in the imbricated formation are also directed toward one another in the intermediate stack.

* * * * *